US010151159B2

(12) United States Patent
Gottlieb et al.

(10) Patent No.: US 10,151,159 B2
(45) Date of Patent: Dec. 11, 2018

(54) KICK DETECTION SYSTEMS AND METHODS

(71) Applicant: Cameron International Corporation, Houston, TX (US)

(72) Inventors: Emanuel J. Gottlieb, Pittsburgh, PA (US); Donald S. Coonrod, Katy, TX (US); Donald R. Augenstein, Pittsburgh, PA (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 69 days.

(21) Appl. No.: 14/735,273

(22) Filed: Jun. 10, 2015

(65) Prior Publication Data

US 2015/0361742 A1 Dec. 17, 2015

Related U.S. Application Data

(60) Provisional application No. 62/011,314, filed on Jun. 12, 2014.

(51) Int. Cl.

| | |
|---|---|
| ***E21B 7/12*** | (2006.01) |
| ***E21B 21/08*** | (2006.01) |
| ***E21B 47/06*** | (2012.01) |
| ***E21B 47/10*** | (2012.01) |
| ***E21B 47/00*** | (2012.01) |
| ***E21B 21/00*** | (2006.01) |

(52) U.S. Cl.

CPC ..... *E21B 21/08* (2013.01); *E21B 21/001* (2013.01); *E21B 47/0001* (2013.01); *E21B 47/101* (2013.01)

(58) Field of Classification Search

CPC ..... E21B 7/12; E21B 21/001; E21B 21/08; E21B 47/06; E21B 47/10; E21B 47/101; E21B 47/0001

See application file for complete search history.

(56) References Cited

U.S. PATENT DOCUMENTS

| | | | | |
|---|---|---|---|---|
| 4,522,068 A | | 6/1985 | Smith | |
| 4,571,693 A | | 2/1986 | Birchak et al. | |
| 5,006,845 A | * | 4/1991 | Calcar | E21B 21/001 166/336 |

(Continued)

FOREIGN PATENT DOCUMENTS

FR 2533618 A1 3/1984

OTHER PUBLICATIONS

Certified translation of FR2533618, translated Jul. 9, 2018, PTO 133214 (Year: 2018).*

(Continued)

*Primary Examiner* — Cathleen R Hutchins

(57) ABSTRACT

An apparatus for detecting potential kicks in a well is provided. In one embodiment, the apparatus includes a drill string positioned in a well, a mud circulation system coupled to supply drilling mud to the drill string, and a mud analyzer. The mud analyzer includes a sensor that is positioned along a drilling mud return path closer to a wellhead assembly installed at the well than to a mud tank of the mud circulation system, and the mud analyzer enables identification of a potential formation kick based on data acquired by the sensor. Additional systems, devices, and methods are also disclosed.

15 Claims, 5 Drawing Sheets

(56) References Cited

U.S. PATENT DOCUMENTS

| | | | | |
|---|---|---|---|---|
| 5,063,776 | A * | 11/1991 | Zanker | E21B 21/08 73/1.34 |
| 5,708,191 | A | 1/1998 | Greenwood et al. | |
| 6,768,106 | B2 | 7/2004 | Gzara et al. | |
| 8,130,591 | B2 | 3/2012 | Geerits | |
| 2002/0121369 | A1 | 9/2002 | Allen | |
| 2004/0095847 | A1 | 5/2004 | Hassan et al. | |
| 2006/0016592 | A1 | 1/2006 | Wu | |
| 2012/0037361 | A1 | 2/2012 | Santos et al. | |
| 2012/0060625 | A1* | 3/2012 | Dietz | E21B 21/08 73/861.42 |
| 2013/0341094 | A1 | 12/2013 | Taherian et al. | |
| 2014/0110169 | A1 | 4/2014 | Santos et al. | |

OTHER PUBLICATIONS

Hayman, Ultrasonic Properties of Oil-Well Drilling Muds, IEEE Ultrasonics Symposium, Oct. 3, 1989, pp. 327-332, vol. 1, IEEE, Montreal, Quebec.

Molz et al., Ultrasonic Velocity and Attenuation Measurements in High Density Drilling Muds, SPWLA 39th Annual Logging Symposium, May 26, 1998, pp. 1-9, Society of Petrophysicists and Well-Log Analysts, Keystone, Colorado.

* cited by examiner

KICK DETECTION SYSTEMS AND METHODS

STATEMENT REGARDING FEDERALLY SPONSORED RESEARCH OR DEVELOPMENT

This invention was made with United States government support under Contract No. 10121-4304-1 awarded by the Research Partnership to Secure Energy for America with funding from the United States Department of Energy. The United States government has certain rights in the invention.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

Drilling fluid (often a drilling mud) is used within wells for various reasons, such as to inhibit flow of formation fluids into the wells, to clean and cool drill bits, and to remove wellbore cuttings. Drilling mud can be circulated through a well by pumping the drilling mud from a mud pit at the surface down into a well through a drill string. The drilling mud can exit the drill string at the bottom of the well and then return up the well through the annular space between the drill string and the well walls. To inhibit the flow of formation fluids into the wells, the wells can be maintained in an overbalanced state in which the weight of the drilling mud applies a greater pressure on the bottom of the well than the pressure of the formation fluids in the subsurface rocks. Drilling fluids engineers monitor and regulate the properties of the drilling mud or other drilling fluids, but in some instances the drilling mud or other fluids may be insufficient to prevent formation fluid from flowing into the well (known as a "kick").

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to monitoring drilling fluids for potential formation kicks in wells. In some embodiments, drilling mud analyzers are used to monitor drilling mud returning from wells and identify potential kick events based on measured or inferred changes in the drilling mud. For example, a mud analyzer could detect a change in drilling mud density indicative of a possible kick event and initiate some response, such as notifying an operator or closing a blowout preventer. Drilling mud returns can be monitored at the well, rather than at mud tanks, to enable faster detection of potential kicks and to increase the time available for corrective action. Further, in certain embodiments, the drilling mud analyzer includes an ultrasonic meter and detects changes in a parameter of an ultrasonic signal to infer changes in the drilling mud indicative of a potential kick.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
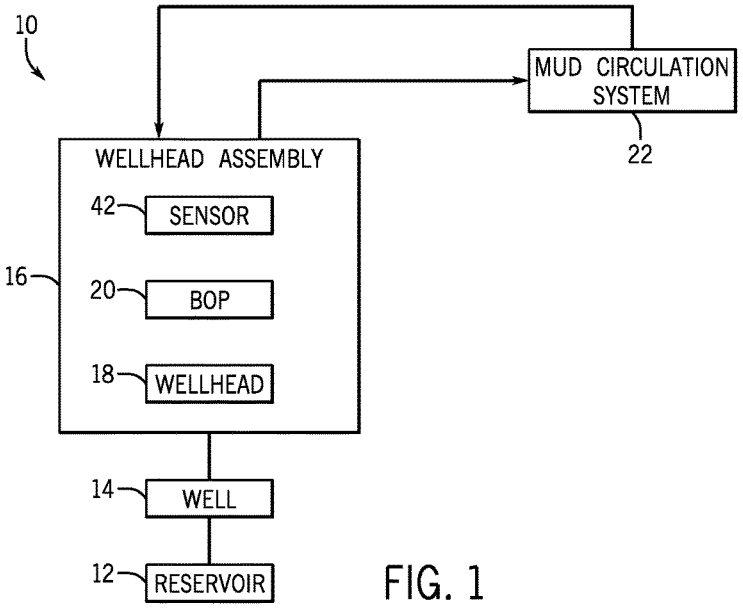
FIG. 1 generally depicts a drilling system including a wellhead assembly provided at a well and a mud circulation system for routing drilling mud through the well in accordance with one embodiment of the present disclosure.

Turning now to the present figures, a system 10 is illustrated in FIG. 1 in accordance with one embodiment. The system 10 is a drilling system that facilitates accessing of a resource, such as oil, from a reservoir 12 through a well 14. A wellhead assembly 16 is installed on the well 14. As depicted, the wellhead assembly 16 includes a wellhead 18 and a blowout preventer 20. Wellheads 18 can include various components, such as casing heads, tubing heads, spools, and hangers. Any suitable blowout preventer 20 could be coupled to the wellhead 18, such as a ram-type preventer or an annular preventer. Indeed, in some embodiments the wellhead assembly 16 includes multiple blowout preventers 20 (e.g., ram-type preventers with pipe rams and shear rams, and an annular preventer). In marine contexts, the wellhead assembly 16 could also include a lower marine riser package coupled between a blowout preventer 20 and a marine riser.

Figure 2:
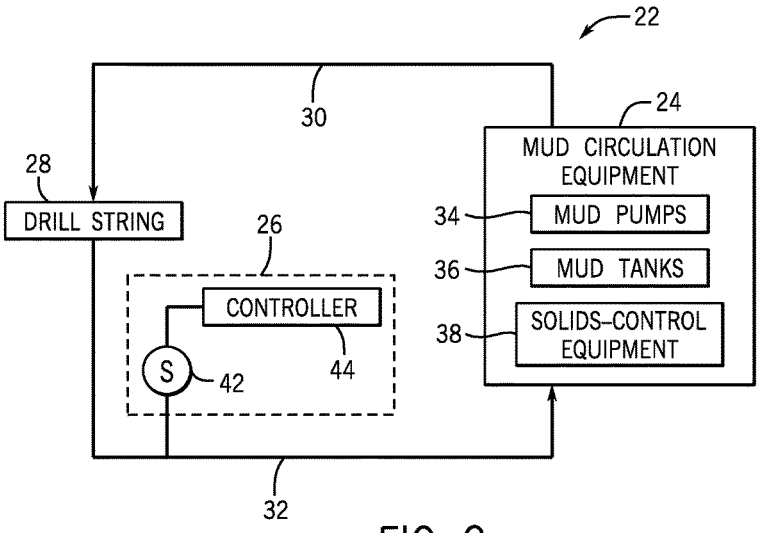
FIG. 2 is an example of the mud circulation system of FIG. 1 for routing drilling mud through a drill string and a mud analyzer positioned along a mud return path of the mud circulation system in accordance with one embodiment.

The system 10 further includes a mud circulation system 22 for routing drilling mud through the well 14. One example of the mud circulation system 22 is shown in FIG. 2. In this depicted embodiment, the mud circulation system 22 includes mud circulation equipment 24. Using a pump 34, drilling mud can be routed from a mud tank 36 to a drill string 28 in the well 14 via a mud supply path 30 (e.g., pipes or hoses for transmitting pumped drilling mud to the drill string 28). The drilling mud can be routed down the drill string 28 to the bottom of the well 14. Drilling mud exiting the drill string 28 at the bottom of the well 14 can then return to the mud circulation equipment 24 via a mud return path 32. In this depicted embodiment, a drilling mud analyzer 26 having at least one sensor 42 and a controller 44 is positioned along the return path 32 for monitoring drilling mud returns to detect formation kicks in the well, as described in greater detail below.

Figure 3:
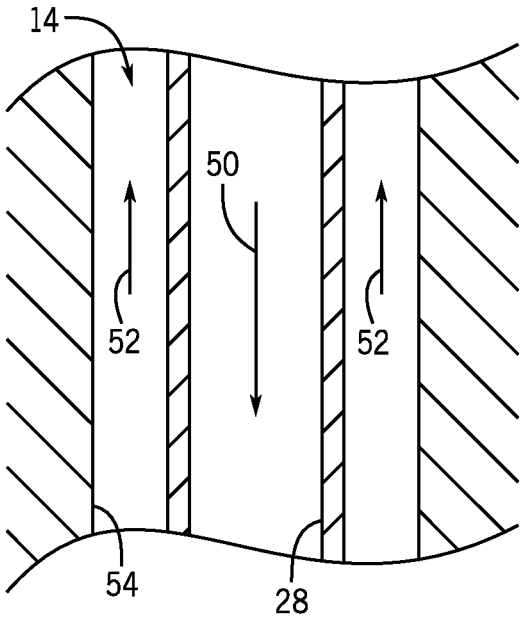
FIG. 3 shows the direction of drilling mud flow down a drill string and up a well in accordance with one embodiment.

The mud return path 32 includes the annular space between the drill string 28 and the walls of the well 14 through which the drilling mud returns to the surface after exiting the drill string 28. Circulation of the drilling mud down through the drill string 28 and then up the surrounding annular space is generally represented in FIG. 3. Particularly, as shown here, drilling mud can be pumped down the drill string 28 (as represented by arrow 50), and drilling mud that has exited the drill string 28 may flow back toward the surface (as represented by arrows 52) through the annular space between the drill string 28 and walls 54 of the well 14.

In some embodiments, the drilling mud is routed from the well 14 and back to the mud circulation equipment 24. In these cases, the mud return path 32 also includes any conduits through which the drilling mud returns to the mud circulation equipment 24 from the well 14. The depicted mud circulation equipment 24 includes equipment 38 for controlling solids in the returning drilling mud. In various embodiments, this solids-control equipment 38 includes shale shakers, desanders, desilters, or the like for removing wellbore cuttings and other particulates from the returning drilling mud. The mud circulation equipment 24 could also a degasser for removing gas from the returning drilling mud. The conditioned drilling mud can then be stored in the mud tanks 36 and reused in the well 14. Although the present embodiment is described in the context of a drilling mud, it is noted that other drilling fluids could also or instead be used in accordance with the present techniques.

With an onshore drilling system, drilling mud exits the well 14 at the surface and can then be returned to the mud tanks 36. In offshore drilling systems, the drilling mud returns leaving the well 14 can be conveyed from a subsea wellhead assembly 16 to a drilling platform at the surface. Two examples of such offshore embodiments are depicted in FIGS. 4 and 5.

In the first example, an offshore drilling system 60 includes a drilling rig 62 connected to a subsea wellhead assembly 16 by a marine riser 64. The drilling rig 62 is presently depicted as a semi-submersible, but it will be appreciated that the drilling rig 62 could be provided in other forms (e.g., a drillship or jackup rig). A drill string 28 can be run from the drilling rig 62 through the marine riser 64 and subsea wellhead assembly 16 into the well 14. Using mud circulation equipment 24 provided on the drilling rig 62, drilling mud can be routed down through the drill string 28 (which extends through the marine riser 64) into the well 14. Once it exits the drill string 28, the drilling mud can return up the annular space between the drill string 28 and the walls 54 of the well 14, as described above. After returning up to the subsea wellhead assembly 16, the drilling mud can be routed up to the drilling rig 62 through the annular space between the drill string 28 and the marine riser 64. Thus, in this embodiment, the drilling mud flowing from the drill string 28 back to mud circulation equipment 24 on the drilling rig 62 follows a return path 32 that includes the annular space between the drill string 28 and the walls 54 of the well 14 and the annular space between the drill string 28 and the marine riser 64. The drilling mud returned to the drilling rig 62 can be routed through the solids-control equipment 38 and back into the mud tanks 36 (e.g., on the drill floor of the rig 62).

Figure 4:
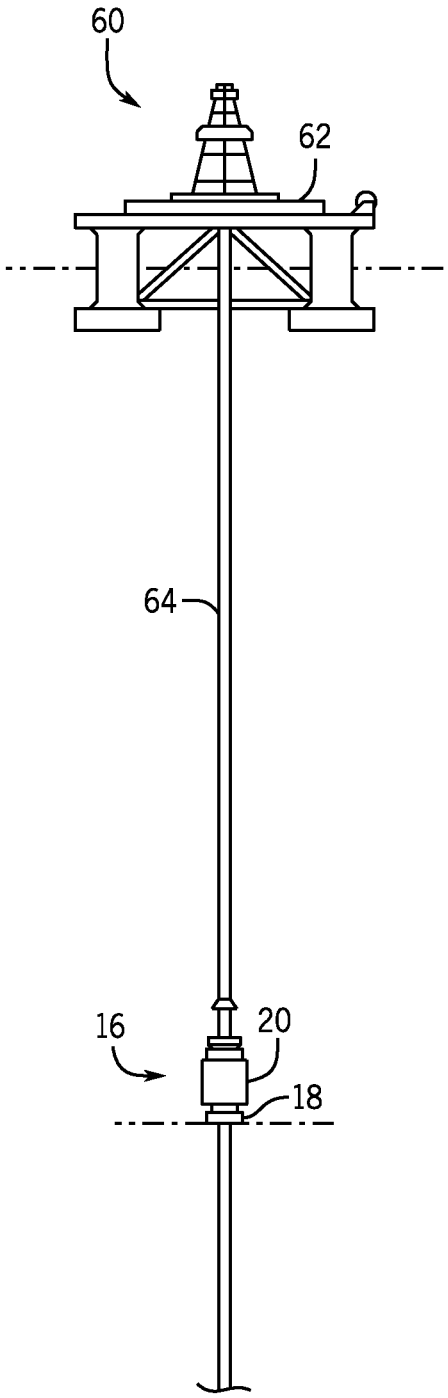
FIG. 4 depicts an offshore drilling system with a drilling rig connected to a subsea wellhead assembly with a marine riser in accordance with one embodiment.
Figure 5:
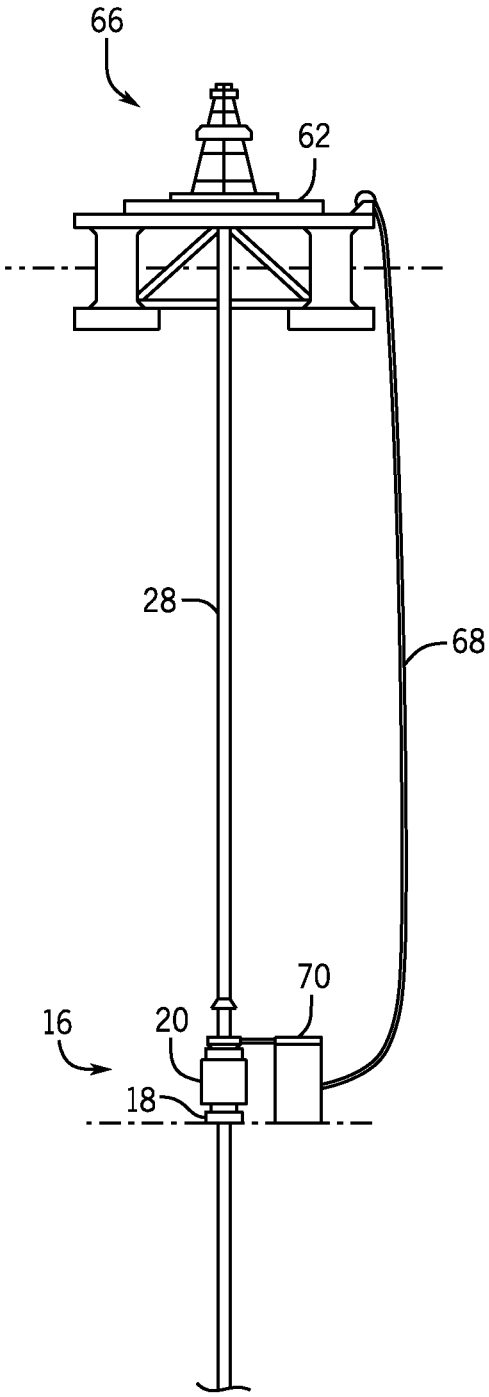
FIG. 5 depicts an offshore drilling system without a marine riser, in which drilling mud returns are routed from a subsea wellhead assembly to a drilling rig through a mud return line, in accordance with one embodiment.

In the second example of FIG. 5, an offshore drilling system 66 includes a drilling rig 62, such as in FIG. 4, but does not include a marine riser 64. Instead, the drill string 28 is run from the drilling rig 62 through the water and into the subsea wellhead assembly 16 and the well 14. Drilling mud can be pumped from the drilling rig 62 (e.g., with onboard mud circulation equipment 24) down the drill string 28 into the well 14, and the drilling mud exiting the bottom of the drill string 28 can flow up to the subsea wellhead assembly 16 through the annular space about the drill string 28 in the well 14. But rather than returning to the surface from the wellhead assembly 16 through a marine riser 64, in system 66 the drilling mud returns from the wellhead assembly 16 to the drilling rig 62 through a mud return line 68. As depicted in FIG. 5, one or more subsea pumps 70 could be used to pump the drilling mud from the seabed to the drilling rig 62. And as in system 60, the drilling mud returning to the drilling rig 62 of system 66 can be conditioned (e.g., by passing through the solids-control equipment 38 and a degasser) and returned to mud tanks 36 for future use. It will be appreciated that the return path 32 followed by the drilling mud in this embodiment includes the annular space about the drill string 28 in the well 14 and the mud return line 68.

As noted above, drilling mud is used to inhibit flow of formation fluids into wells. But kicks can occur for various reasons, such as upon encountering abnormally high pressure in the subsurface during drilling or as a result of unintended fracturing of a formation by the drilling mud. As formation fluid (e.g., water, oil, or natural gas) flows into the well during a kick, the formation fluid mixes with and dilutes the drilling mud. This dilution causes the drilling mud column within the well to become even lighter and apply less balancing pressure against the formation pressure, which could lead to more formation fluid entering the well and mixing with the drilling mud. Uncontrolled flow of formation fluids up the well to the surface is typically undesirable. After a kick is detected, a well can be killed by activating one or more blowout preventers and pumping heavier drilling mud (kill mud) into the well to circulate the kick out.

Kicks can be detected in various ways. For example, using the mud analyzer 26, kicks can be inferred from changes in the drilling mud in the return path 32. In at least some embodiments, the controller 44 is programmed or otherwise configured to monitor a drilling mud parameter by receiving and analyzing data from the sensor 42, to identify a potential kick based on a change in the drilling mud parameter, and to initiate a response to the identified kick. Parameters of the drilling mud that may vary during a kick can include, among others, temperature, density, gas content, pressure, and flow volume of the mud. One or more sensors 42 can be used to monitor at least one drilling mud parameter and the controller 44 can be used to detect changes in the parameter indicative of kicks. Once a kick event is detected, a suitable response can be identified and then carried out by the controller 44, such as triggering an alert of a potential kick event to an operator (who may then decide whether and what further actions should be taken) or automatically closing a blowout preventer.

In some instances, the controller 44 can monitor a drilling mud parameter of interest and compare the monitored parameter, or an amount or rate of change in the monitored parameter, to a threshold to identify kicks. For example, the mass flow rate or density of the drilling mud returning via the return path 32 can be monitored (e.g., using a sensor 42 in the form of a Coriolis meter at mud circulation equipment 24 on the drilling rig 62) and compared with a lower threshold, where the controller 44 identifies a kick event as occurring when the monitored parameter drops below the lower threshold. In another instance, the amount or rate of change in the monitored parameter can be compared to a suitable deviation threshold to identify kick events. Multiple thresholds could also be used to classify potential kick events, such as by likelihood or magnitude. For example, a smaller deviation threshold could be used to identify possible kick events and a larger deviation threshold could be used to identify probable kick events. The thresholds can also be used to determine the response to be taken, such as the controller 44 notifying an operator of a potential issue when one threshold is passed and automatically closing a blowout preventer 20 when a different threshold is passed.

The mud analyzer 26 can include a sensor 42 provided along the mud return path 32 at the surface near the mud tanks 36 to allow monitoring of the drilling mud that has returned from the well to mud circulation equipment 24 at the surface. But in at least some embodiments, the mud analyzer 26 also or instead includes a sensor 42 provided along the mud return path 32 further away from the mud tanks 36. By moving the sensor 42 away from the mud tanks 36 and closer to the source of any kick within the well 14, the transit time of the drilling mud between the source of any kick and the sensor 42 is reduced. This, in turn, allows the mud analyzer 26 to more quickly detect kick events (potential or actual) and increases the amount of time available for consideration and implementation of a suitable response, such as shutting-in the well and injecting kill mud. The sensor 42 can be provided at the well 14 in some instances (e.g., by providing the sensor 42 in the well 14 or at its wellhead assembly 16).

In at least some embodiments, a sensor 42 is provided at the wellhead assembly 16 to monitor drilling mud returns as they exit the well 14. In subsea embodiments, such as those depicted in FIGS. 4 and 5, this allows the mud analyzer 26 to detect kicks from the returning drilling mud at the seabed, rather than waiting for the drilling mud (and formation fluids in the event of a kick) to return to the surface through the marine riser 64 or return line 68. The controller 44 can be positioned with one or more of the sensors 42, but could also be provided remote from any sensors 42. In one subsea embodiment, the sensor 42 is provided at the wellhead assembly 16 and the controller 44 is provided at the surface on the drilling rig 62.

The sensor 42 can be provided as any suitable meter or device for sensing a drilling mud parameter of interest. As noted above, a sensor 42 can be provided in the form of a Coriolis meter, which can be used to monitor drilling mud flow rate parameters and density. In at least some embodiments, however, the sensor 42 is provided in the form of an ultrasonic meter that uses ultrasonic waves to monitor the drilling mud. In such embodiments, the mud analyzer 26 may be referred to as an ultrasonic mud analyzer.

Figure 6:
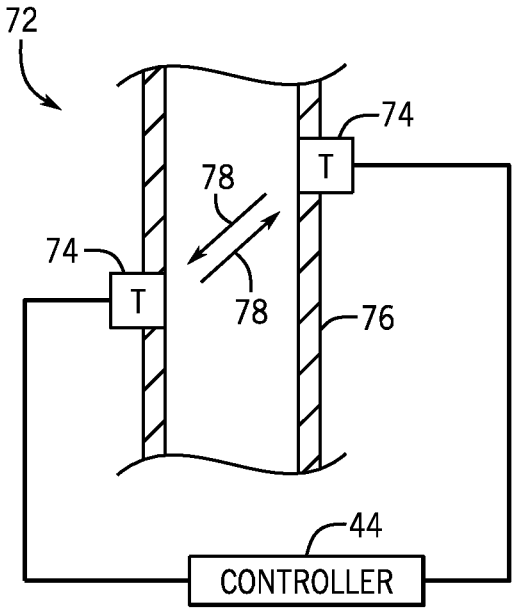
FIG. 6 depicts one example of the mud analyzer of FIG. 2, in which the sensor is provided as an ultrasonic meter for monitoring drilling mud returns, in accordance with one embodiment.

One example of an ultrasonic meter 72 is generally depicted in FIG. 6 as having ultrasonic transducers 74 and a meter body 76. While drilling mud is routed through a conduit of the meter body 76, the ultrasonic transducers 74 can transmit and detect acoustic signals (in the form of ultrasonic waves 78) in the drilling mud. In at least some embodiments, the ultrasonic transducers 74 have a transmit frequency between 40 kHz and 1 MHz (e.g., 200 kHz) and are operated in pitch-catch mode. The received ultrasonic waves 78 can be used to detect (e.g., by inferring) certain characteristics of the drilling mud. The ultrasonic meter 72 can measure, for instance, the velocity of sound through the drilling mud, the gain (the amplification of the received ultrasonic signal, which can be measured in decibels), and the frequency of the acoustic signal transmitted through the drilling mud via the transducers 74. Further, these parameters of the acoustic signal may vary based on the density of the drilling mud through which the signal passes, allowing changes in drilling mud density to be detected based on changes in the acoustic signal parameters. The controller 44 can be used to control the transducers 74 and process electrical signals indicative of the sensed parameter from the transducers 74.

In at least some embodiments, an ultrasonic mud analyzer 26 is used to measure one or more parameters of the acoustic signal passing through the drilling mud to detect kick events. In one example, the gain of the ultrasonic signal in the ultrasonic meter 72 can be monitored, with variations in the monitored gain indicative of changes in the density of the drilling mud through which the ultrasonic signal passes. For example, an increase or decrease in the density of the drilling mud can be inferred from an increase or decrease in the gain (or other parameter) of the ultrasonic signal. Thus, changes in the monitored gain can also be used to detect kicks. The monitored ultrasonic parameters can also be compared to thresholds in the manner described above (e.g., for classification and response). For example, the meter 72 (or some other sensor 42) and the controller 44 can be used as an early kick detection alarm system that is activated (e.g., triggering an alarm to notify an operator or closing a blowout preventer) when gain (or some other parameter) passes a set threshold.

As generally noted above, earlier detection of possible kick events can be provided by monitoring the drilling mud returns at a location along the mud return path 32 that is closer to sources of the potential kicks. In some embodiments, the ultrasonic meter 72 is provided (as the sensor 42) at a subsea wellhead assembly 16 and provides an earlier indication of a step change in drilling mud density (and, thus, an earlier detection of potential formation kicks) compared to monitoring the drilling mud on the drilling rig 62 at the surface of the water.

Figure 7:
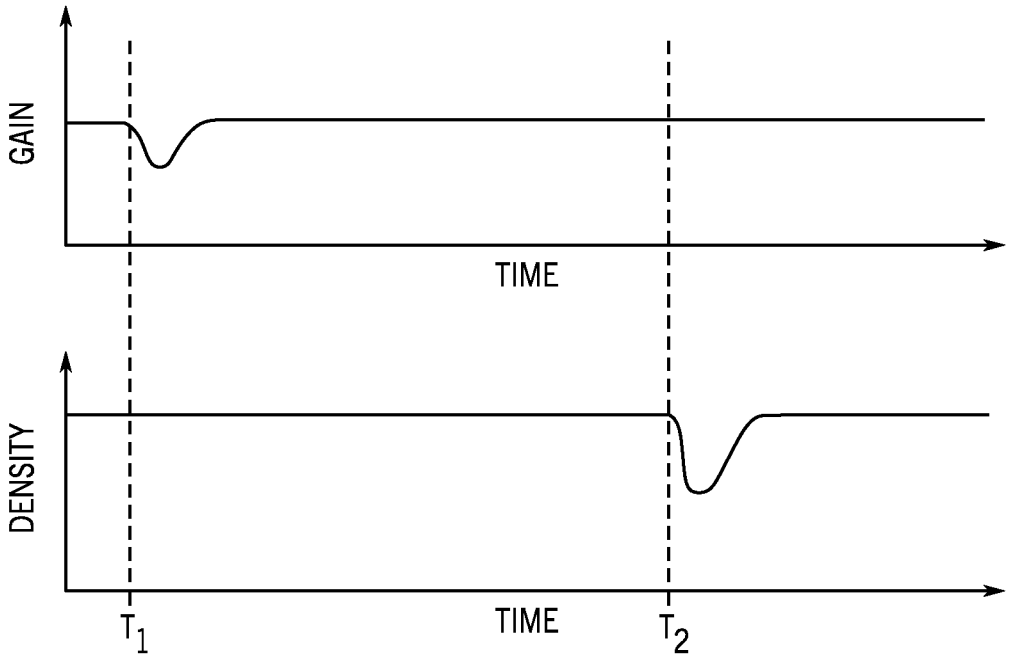
FIGS. 7 and 8 are graphs showing detection of a change in gain by the ultrasonic meter of FIG. 6 indicative of a change in drilling mud density and of a potential kick event, and subsequent measurement of drilling mud density downstream from the ultrasonic meter, in accordance with certain embodiments.
Figure 8:
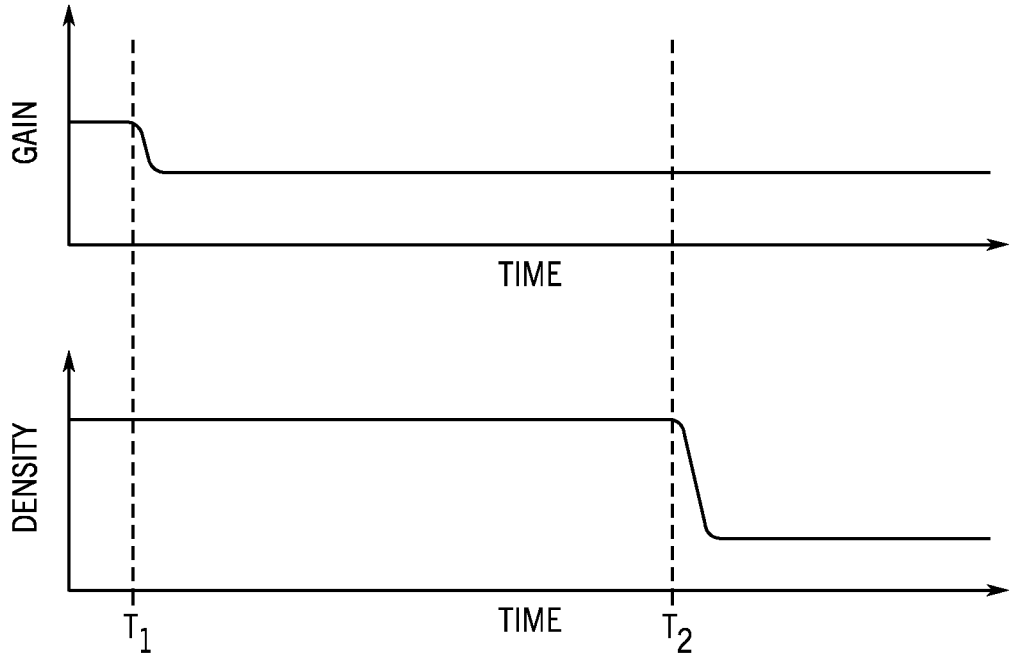

Comparisons of changes in the gain measured by the ultrasonic meter 72 at a subsea wellhead assembly 16 and corresponding changes in drilling mud density measured on the surface (e.g., near the mud tanks 36 with a Coriolis meter) are generally depicted in FIGS. 7 and 8. In each of these figures, the upper plot represents gain measured at the wellhead assembly using an ultrasonic meter 72 and the lower plot represents density measured by a sensor at the surface. In FIG. 7, a transient decrease in the gain is indicated at time $T_1$, from which a corresponding decrease in the drilling mud density can be inferred. The drilling mud analyzed by the ultrasonic meter 72 at time $T_1$ would travel along the return path 32 and then reach the surface density sensor at time $T_2$. A corresponding decrease in the drilling mud density measured at the surface at time $T_2$ would confirm the change in density inferred from the change in gain at time $T_1$. In FIG. 8, the subsea ultrasonic meter 72 registers (starting at time $T_1$) a change in the gain to a new level, which can be indicative of a sustained kick in which the returning drilling mud is being continuously diluted by formation fluids entering the well. And as before, a corresponding change in the drilling mud density measured at the surface can be detected at time $T_2$. It will be appreciated that the responses initiated by the controller 44 of the mud analyzer 26 can depend on the length and magnitude of changes in the monitored parameter.

Figure 9:
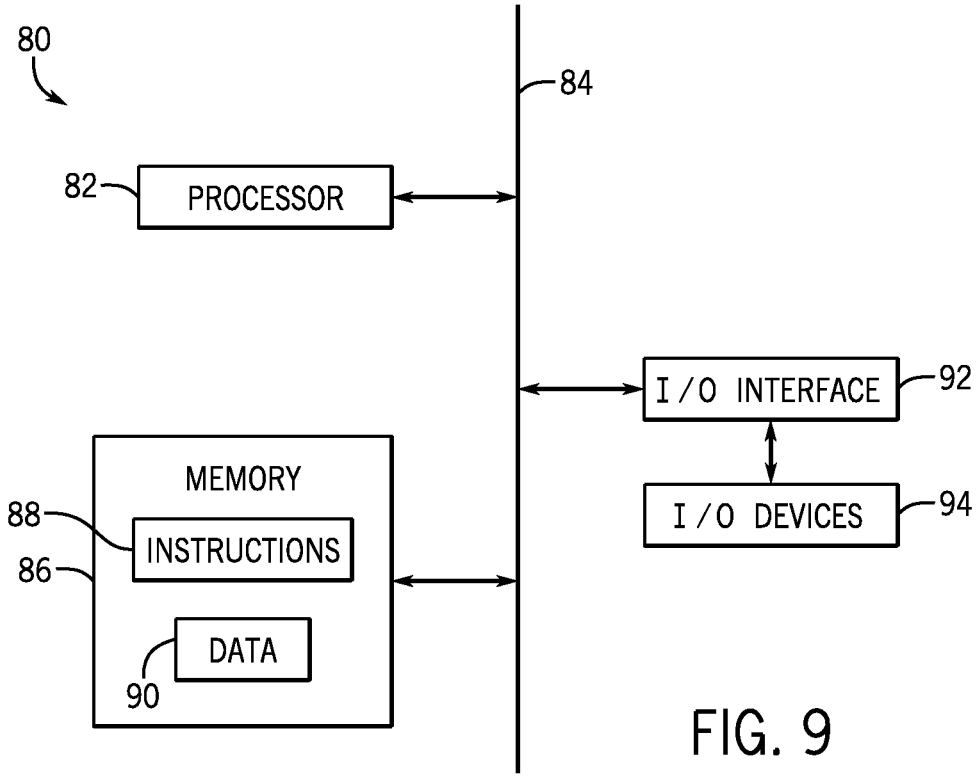
FIG. 9 is a block diagram of a programmable controller of the mud analyzer in accordance with one embodiment.

Finally, it is noted that the controller 44 for implementing various functionality described above (e.g., kick detection and response) can be provided in any suitable form. In at least some embodiments, such a controller 44 is provided in the form of a processor-based system, an example of which is provided in FIG. 9 and generally denoted by reference numeral 80. In this depicted embodiment, the system 80 includes a processor 82 connected by a bus 84 to a memory device 86. It will be appreciated that the system 80 could also include multiple processors or memory devices, and that such memory devices can include volatile memory (e.g., random-access memory) or non-volatile memory (e.g., flash memory and a read-only memory). The one or more memory devices 86 are encoded with application instructions 88 (e.g., software executable by the processor 82 to perform the monitoring and kick detection functionality described above), as well as with data 90 (e.g., thresholds for comparison to measured parameters and deviations). In one embodiment, the application instructions 88 are stored in a read-only memory and the data 90 is stored in a writeable non-volatile memory (e.g., a flash memory).

The system 80 also includes an interface 92 that enables communication between the processor 82 and various input or output devices 94. The interface 92 can include any suitable device that enables such communication, such as a modem or a serial port. The input and output devices 94 can include any number of suitable devices. For example, in one embodiment the devices 94 include one or more sensors 42 for providing input of measured parameters (e.g., density of drilling mud or ultrasonic parameters indicative thereof, such as gain, frequency, or velocity of sound) to the system 80, a keyboard to allow user-input to the system 80, and a display or printer to output information from the system 80 to a user. The input and output devices 94 can be provided as part of the system 80, although in other embodiments such devices may be separately provided.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a drill string positioned in a well;

a mud circulation system coupled to supply drilling mud to the drill string; and a mud analyzer including a sensor that is positioned along a drilling mud return path closer to a wellhead assembly installed at the well than to a mud tank of the mud circulation system, wherein the mud analyzer enables identification of a potential formation kick based on data acquired by the sensor, the mud analyzer is an ultrasonic mud analyzer configured to monitor a parameter of an ultrasonic signal in the drilling mud and to infer the potential formation kick from a step change in the monitored parameter of the ultrasonic signal, and the parameter of the ultrasonic signal which the ultrasonic mud analyzer is configured to monitor is at least one of frequency or velocity of sound.

2. The apparatus of claim 1, wherein the sensor of the mud analyzer is positioned at the wellhead assembly.

3. The apparatus of claim 1, wherein the sensor is an ultrasonic sensor positioned at a subsea wellhead assembly and enables earlier detection of potential formation kicks compared to detecting the potential formation kicks through monitoring of drilling mud at a drilling rig.

4. The apparatus of claim 1, wherein the well is a subsea well.

5. An apparatus comprising:

a drilling mud analyzer including:

an ultrasonic sensor; and a controller configured to monitor a parameter of an ultrasonic signal in drilling mud and to infer a potential formation kick of a well from a step change in the monitored parameter of the ultrasonic signal, wherein the parameter of the ultrasonic signal which the controller is configured to monitor is at least one of frequency or velocity of sound.

6. The apparatus of claim 5, wherein the ultrasonic sensor is positioned to enable receipt of ultrasonic waves transmitted through the drilling mud within a drilling mud return path from the well to a mud tank.

7. The apparatus of claim 5, wherein the ultrasonic sensor is positioned at a subsea wellhead assembly.

8. The apparatus of claim 5, wherein the ultrasonic sensor includes at least one pair of ultrasonic transducers arranged to cooperate with one another to transmit and receive ultrasonic waves.

9. A method comprising:

circulating drilling fluid through a well, wherein circulating the drilling fluid includes routing the drilling fluid through a supply path to a drill string, through the drill string, and then out of the well via a return path;

monitoring the drilling fluid at the well as the drilling fluid flows through the return path; and detecting a kick based on the monitoring of the drilling fluid at the well;

wherein monitoring the drilling fluid at the well as the drilling fluid flows through the return path includes monitoring, at a location along the return path, a parameter that varies based on the density of the drilling fluid, and wherein detecting the kick based on the monitoring of the drilling fluid at the well includes determining a deviation of the parameter measured at the location along the return path from a prior measurement of the parameter at the location along the return path and comparing a magnitude of the deviation to a deviation threshold;

wherein the monitored parameter is at least one of frequency or velocity of sound.

10. The method of claim 9, wherein monitoring the drilling fluid at the well as the drilling fluid flows through the return path includes monitoring the drilling fluid with a sensor at a wellhead assembly.

11. The method of claim 10, wherein monitoring the drilling fluid with the sensor at the wellhead assembly includes monitoring the drilling fluid using an ultrasonic transducer.

12. The method of claim 9, wherein monitoring the parameter that varies based on the density of the drilling fluid includes monitoring an acoustic signal transmitted through the drilling fluid.

13. The method of claim 9, wherein circulating the drilling fluid includes routing the drilling fluid out of the well via the return path to a tank.

14. The method of claim 9, comprising triggering an alert to an operator in response to the detected kick.

15. The method of claim 9, comprising automatically actuating a blowout preventer in response to the detected kick.

* * * * *